US005996668A

United States Patent [19]

DeBlock et al.

[11] Patent Number: 5,996,668

[45] Date of Patent: Dec. 7, 1999

[54] ADJUSTABLE BLIND ASSEMBLY

[75] Inventors: David A. DeBlock, Holland; Errol S. Pearsons, Grand Haven; James L. Willis, Hudsonville, all of Mich.

[73] Assignee: ODL, Incorporated, Zeeland, Mich.

[21] Appl. No.: 09/134,124

[22] Filed: Aug. 14, 1998

[51] Int. Cl.[6] ..... E06B 9/30

[52] U.S. Cl. ..... 160/107; 160/168.1 R; 160/176.1 R

[58] Field of Search ..... 160/107, 98, 176.1 R, 160/168.1 R, 177 R, 173 R, 172 R

[56] References Cited

U.S. PATENT DOCUMENTS

| | | | |
|---|---|---|---|
| 2,557,978 | 6/1951 | Krumm | 160/107 X |
| 3,318,360 | 5/1967 | Persson | 160/107 |
| 3,443,624 | 5/1969 | Toth | 160/107 |
| 3,703,920 | 11/1972 | Debs | 160/107 |
| 3,719,221 | 3/1973 | Hanson | 160/107 X |
| 3,795,267 | 3/1974 | Debs | 160/107 X |
| 4,817,698 | 4/1989 | Rossini et al. | 160/107 |

*Primary Examiner*—David M. Purol

*Attorney, Agent, or Firm*—Warner Norcross & Judd LLP

[57] ABSTRACT

A blind assembly having a frame entrapping a set of blinds. The frame has an integral track upon which tilt and height control mechanisms are slidably mounted. A height control mechanism is slidably mounted on a vertical portion of the track, and the blinds are raised and lowered by movement of this mechanism. The mechanism is connected to a lift cord retained within the track and hidden from the user's view. This mechanism further includes a spring lock to engage the track and lock the mechanism, and thus the blinds, in a stationary position. A tilt control mechanism is slidably mounted on a horizontal portion of the track, and the blinds are opened and closed by movement of this mechanism. The blinds are protected behind a pane of glass or clear plastic.

23 Claims, 8 Drawing Sheets

ADJUSTABLE BLIND ASSEMBLY

BACKGROUND OF THE INVENTION

The present invention relates to a window blind assembly and, more particularly, to an assembly particularly well adapted for mounting on doors.

Adjustable window blinds are well-known in the prior art. Such blind assemblies include a plurality of slats, usually manufactured of vinyl or aluminum, a "string' ladder, and cords for adjusting tilt and height. The first ends of the height adjustment cords pass through holes cut within each of the slats and is affixed to the lowermost slat, and the second ends dangle from the blind assembly. The ladder has front and rear cords passing along the front and rear edges of the slats, and each slat rests on a thin connector cord attaching the front and rear cords. The front and rear cords are attached to a rotating extension bar along the top of the assembly. A user pulls or releases the height control cords to raise and lower the blinds. Additionally, the user may tilt the blinds open or closed by use of a rotating tilt bar connected to the extension bar.

Conventional blinds are often installed on doors, such as sliding or french doors which have large areas of glass. However, as the doors open and close, the blinds swing freely, hitting the door and marring its finish. Additionally, the slats may be caught by the door as it closes and be permanently bent or twisted. The blinds can also be noisy, especially if caught by wind while the door is open.

The height control cords are dangerous for small children who can become tangled in the dangling cords. The cords may be shortened, or the user may loop the cords over the top of the blind assembly to keep them out of children's reach; however, such preventive measures may fail by the cords slipping off the top of the assembly or the user forgetting to replace the cords after adjusting the blinds.

The rotating tilt bar which extends from the blind assembly is typically attached by a J-hook which can snag window treatments. Additionally, the rotating bar can become twisted on the J-hook and be rendered inoperable. The user must then remove the bar from the assembly and replace it in the correct position on the J-hook.

Further, the slats of the blinds are exposed to dirt and dust and must be cleaned frequently, which is time intensive. The slats are also subject to wear and tear, such as accidental bending of an aluminum or plastic slat which leaves a permanent crease in the slat.

In an attempt to prevent wear and tear of the blinds, window blind assemblies have been installed between the two panes of an insulated glass assembly to keep the blinds clean and free of dust. Such assemblies include a tilt control mechanism consisting of a small rotatable knob built into the frame surrounding the glass and the blinds. However, such blinds may only be tilted open and closed; they do not have a raise/lower feature.

SUMMARY OF THE INVENTION

The present invention overcomes the noted problems by providing a blind assembly having tilt control and height control features slidably mounted on a frame with the cords hidden within the frame. The set of blinds are entrapped in the frame behind a pane of glass or plastic.

The assembly includes a frame having an integral track upon which tilt control and height control mechanisms are located. The height control mechanism, preferably located along a vertical portion of the track, is attached to the lift adjustment cord present on a conventional blind assembly. The lift cord passes through a channel defined by the track so that it is not visible from the front of the frame. Additionally, the height control mechanism includes a spring lock to secure the mechanism in a stationary position on the track. The user may release the spring lock and slide the height mechanism vertically along the track. As the user slides the mechanism up, the set of blinds is lowered; and as the user slides the mechanism down, the blinds are raised. When the user has the blinds in a desired position, the user releases the spring lock, and the mechanism holds its position on the vertical track and, thus, holds the blinds in the desired position.

A tilt control mechanism is preferably mounted on the upper portion of the frame along a horizontal portion of the track. The tilt control mechanism includes a helix operator positioned within the flame and not visible to the user which translates the linear, sliding motion of the tilt control mechanism into a rotational motion. Thus, as a user slides the tilt control Us mechanism to the right and left along the track, the blinds rotate and tilt between open and closed positions.

The present invention provides an effective means of protecting blinds from dirt and wear and tear by placing the blinds behind a protective pane of glass or plastic. Additionally, the height and tilt control mechanisms eliminate dangling cords, which are quite dangerous for small children, and the tilt rotational bar, which may catch on window treatments or become twisted and inoperable. The present invention further provides a contemporary and clean appearance.

These and other objectives, advantages, and features of the invention will be more readily understood and appreciated by reference to the detailed description of the preferred embodiment and the drawings.

DETAILED DESCRIPTION OF THE PREFERRED EMBODIMENT

Figure 1:
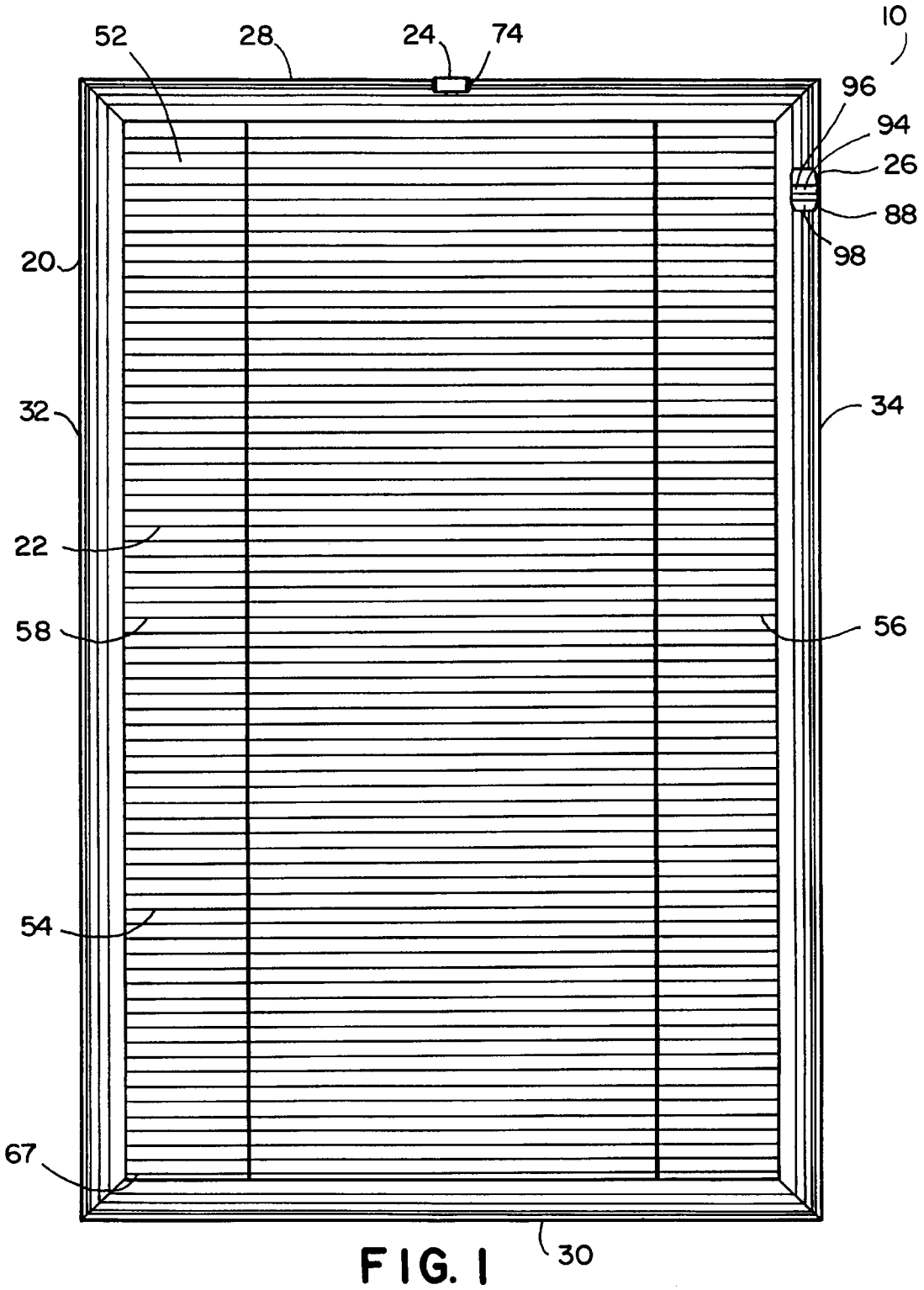
FIG. 1 is a front elevational view of the blind assembly.
Figure 2:
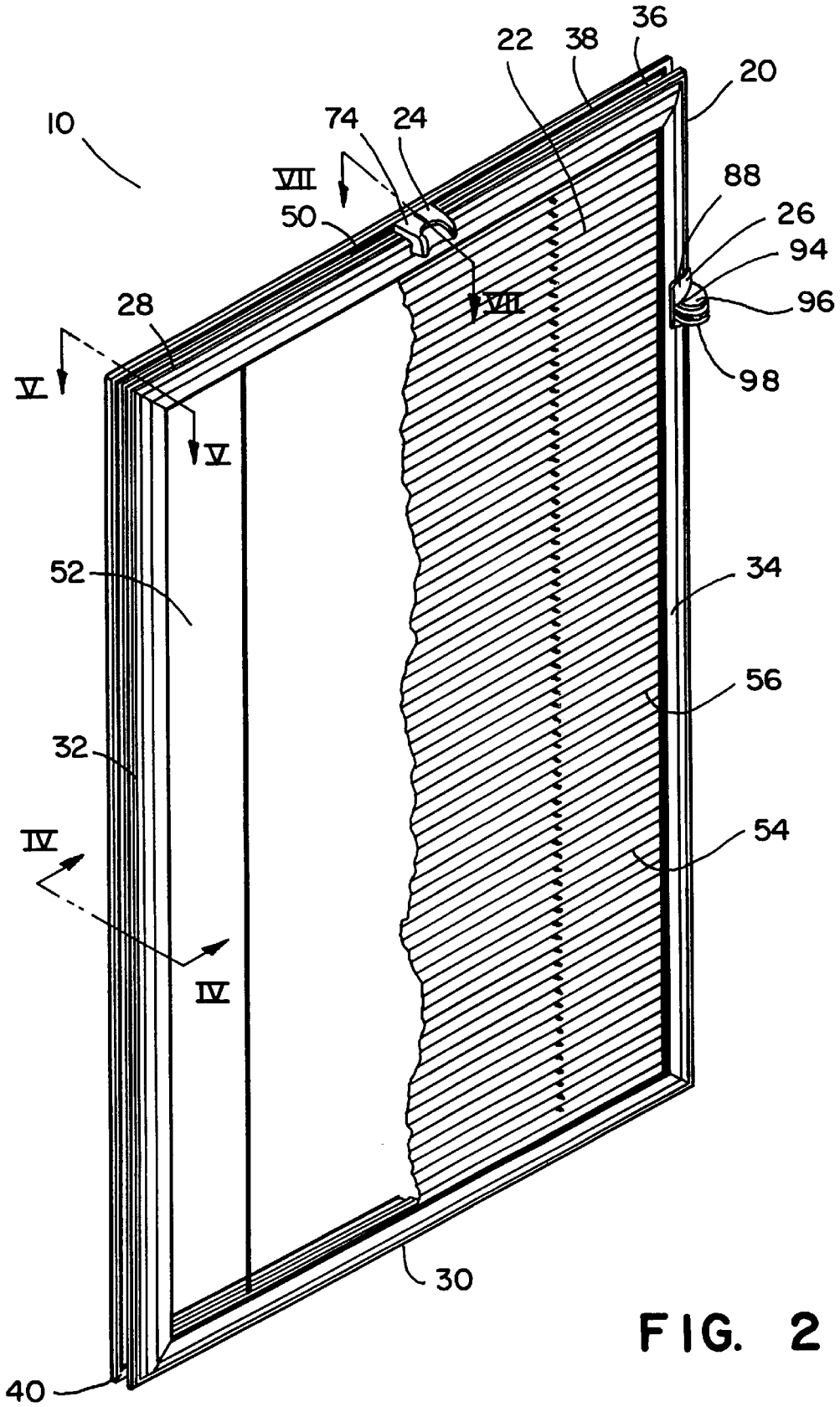
FIG. 2 is a front perspective view of the assembly with a cutaway view of the blinds.
Figure 3:
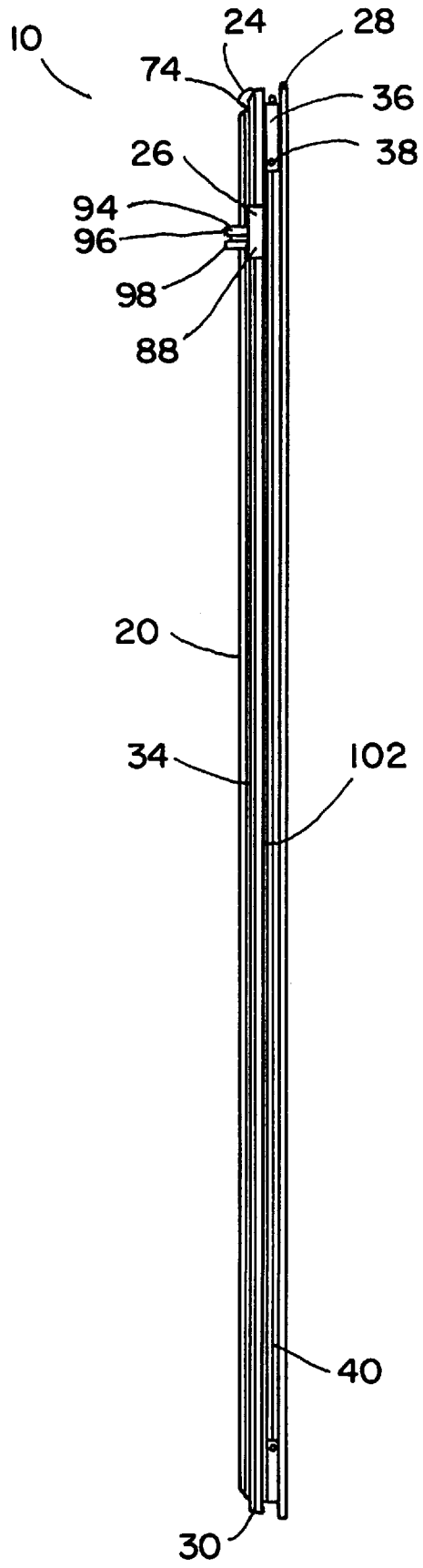
FIG. 3 is a right side elevational view of the blind assembly.

A blind assembly according to a preferred embodiment of this invention is illustrated in FIGS. 1–3 and generally designated 10.

I. Construction of the Assembly

The assembly 10 includes a frame 20, a set of blinds 22, a tilt control mechanism 24, and a height control mechanism 26. The assembly 10 is described for installation over a door light (not shown), i.e. a window installed in a door. However, the assembly 10 may be installed over other, various window types.

The frame 20 is preferably molded of plastic, although other materials, such as wood or metal, may be used. The frame 20 includes top and bottom sides 28 and 30 and left and right sides 32 and 34. The sides 28, 30, 32, and 34 meet at right angles and form a rectangle, although the frame 20 may include a larger or smaller number of sides and form other shapes, such as a triangle or octagon. Each side 28, 30, 32, and 34 is preferably molded as an individual piece, and the sides 28, 30, 32, and 34 are connected by corner keys 36. Each corner key 36 consists of a flat plastic or metal piece bent at a right angle to cover each joint on the frame 20. Each corner key 36 connects one of the sides 28, 30, 32, or 34 to another by a fastening means 38, such as a screw, bolt, nail, or adhesive.

Figure 4:
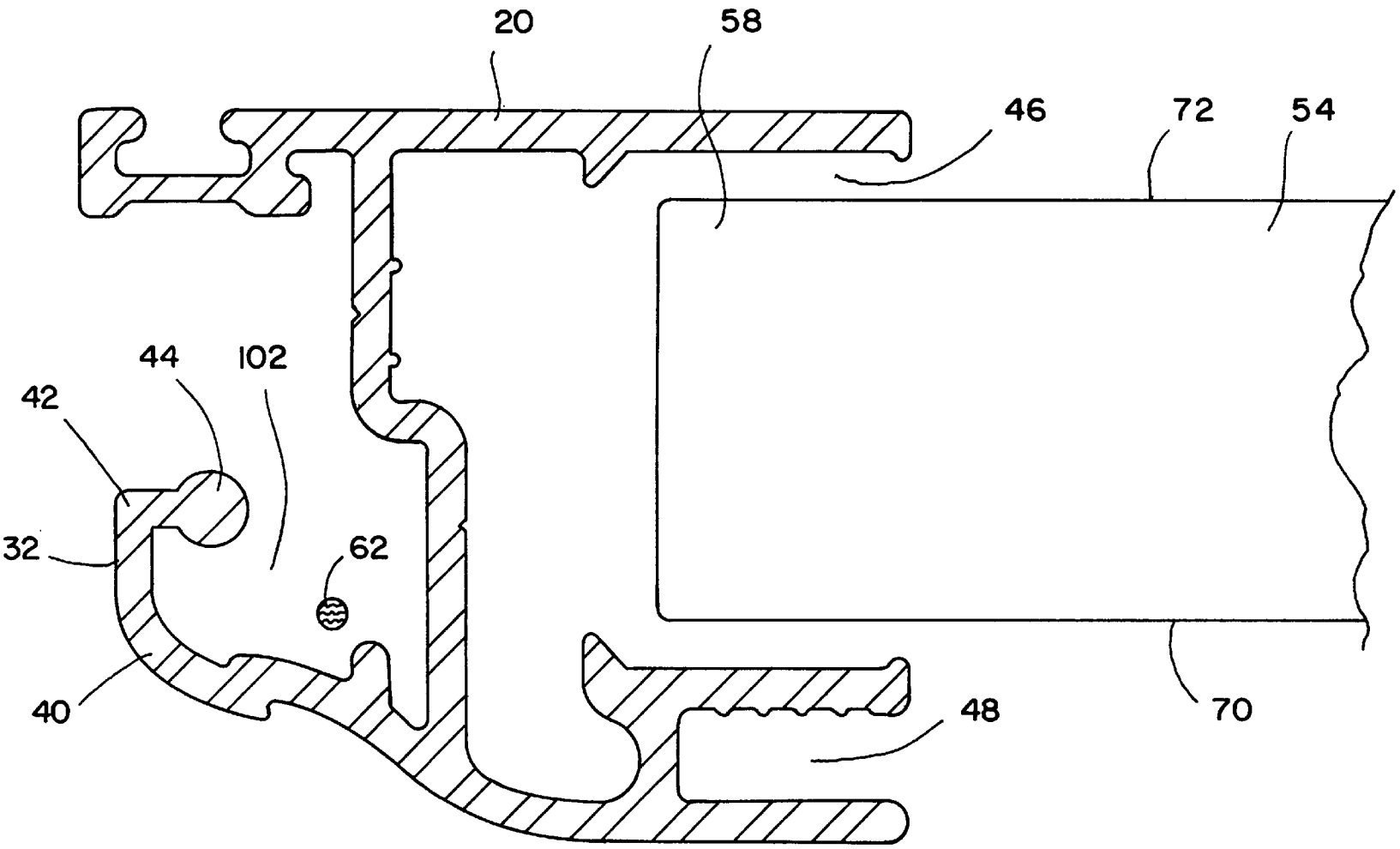
FIG. 4 is a top cross-sectional view of the frame of the blind assembly showing the blinds retained in the flame taken along the line IV—IV in FIG. 2.

As seen in FIGS. 4 and S, each side 28, 30, 32, and 34 of the frame 20 includes an integral track 40, extending along its length. The track 40 includes a rearward extending hook 42 having a bulbous end, or protuberance, 44, both of which act to retain items on the track 40. Further, each side 28, 30, 32, and 34 includes a blind cavity 46, or channel, for retaining the set of blinds 22 within the frame 20. Each side 28, 30, 32, and 34 additionally includes a pane cavity 48, or channel, for retaining a pane of glass or clear plastic (not shown) in front of the set of blinds 22. The top side of the frame 28 includes a narrow cut-away portion 50 which allows access into the interior 52 of the frame 20.

Figure 6:
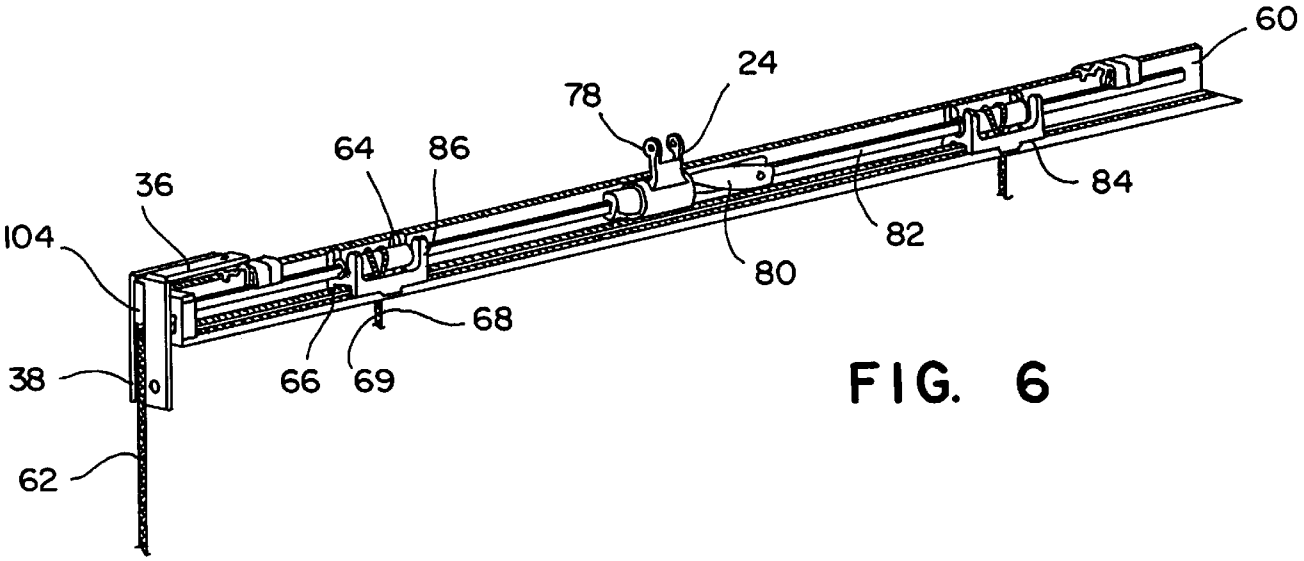
FIG. 6 is a rear perspective of the interior of the header of the blind assembly.
Figure 11:
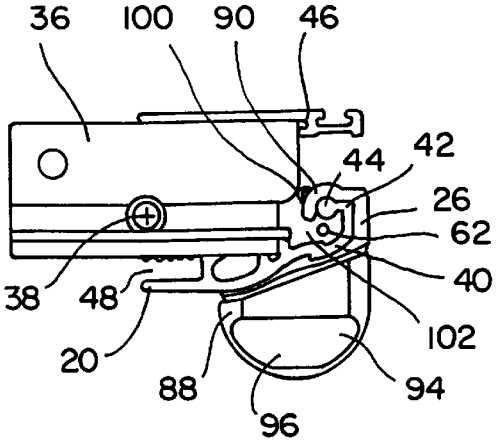
FIG. 11 is a top plan view of the height control mechanism.
Figure 8:
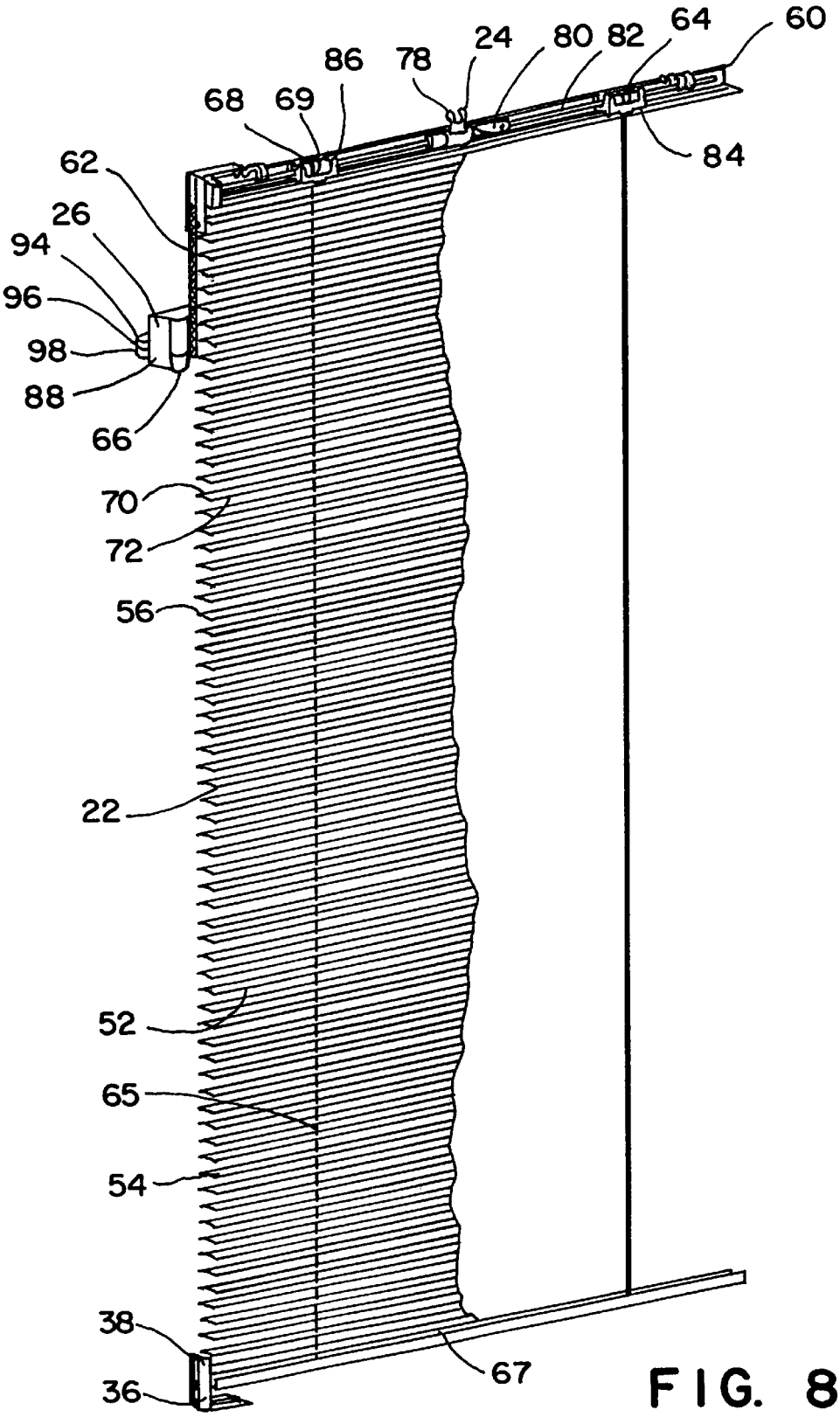
FIG. 8 is a rear perspective view of the height control mechanism.
Figure 9:
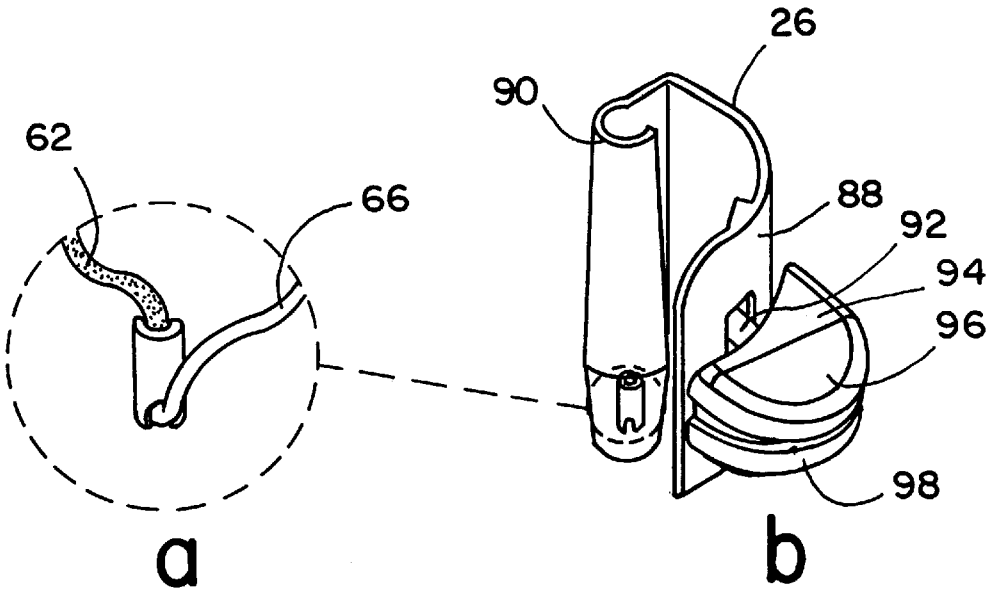
FIG. 9*a* is an expanded view showing the attachment of the lift cord to the height actuator.
FIG. 9*b* is a front perspective view of the height actuator.
Figure 10:
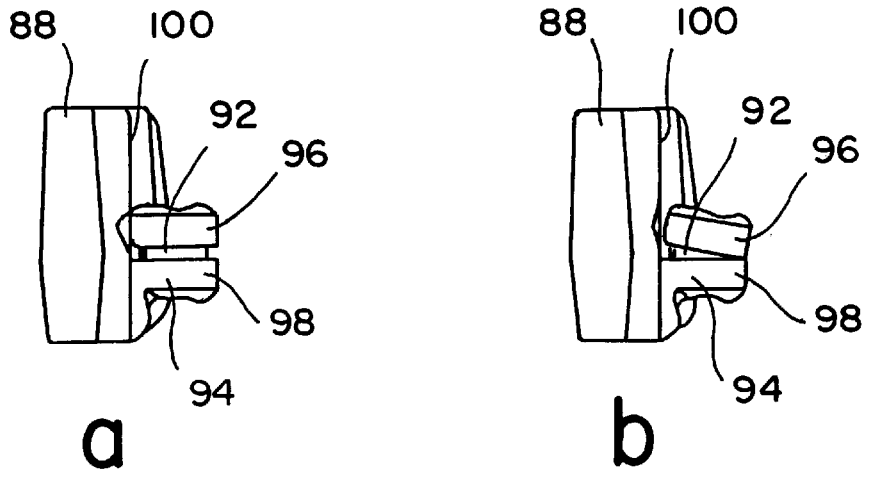
FIG. 10*a* is a right side elevational view of the height actuator in a lock position.
FIG. 10*b* is a right side elevational view of the height actuator in a release position.

The set of blinds 22 are conventional window blinds and, therefore, will not be described in detail. The blinds include a plurality of slats 54, preferably manufactured of vinyl or aluminum; of course, other materials such as wood may be used. The ends 56 and 58 of the slats 54 are loosely retained in the blind cavities 46 of the left and right sides 32 and 34 of the frame 20. A header 60, as seen in FIG. 6, from which the slats 54 are suspended, is fixedly retained in the blind cavity 46 of the top side 28 of the frame 20 by a clip 61. The slats 54 are suspended from conventional lift adjustment and tilt adjustment, or string ladder, cords 62 and 64. The lift adjustment cord 62 has first and second ends 65 and 66; the first end 65 is threaded through apertures (not shown) defined by the slats 54 and secured to the lowermost slat 67. The lift cord 62 passes through the interior of the track 40 so that it is not visible to the user from the front or side of the frame 20. Front and rear tilt adjustment cords 68 and 69 extend along the front and rear edges 70 and 72 of the slats 54. A connector cord (not shown) extends between the front and rear tilt adjustment cords 68 and 69 and supports each slat 54. The top of the tilt adjustment cords 68 and 69 are secured within the header 60.

Figure 7:
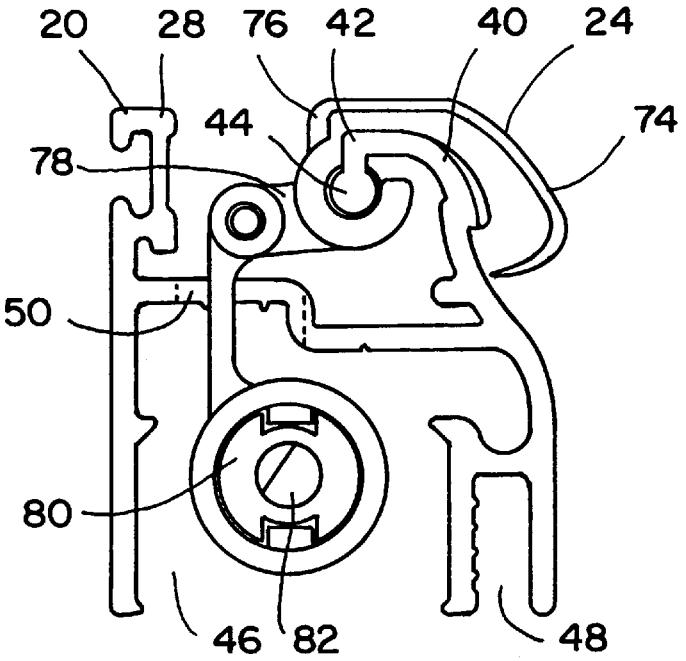
FIG. 7 is a right side cross-sectional view of the frame showing the tilt control mechanism taken along line VII—VII in FIG. 2.
Figure 5:
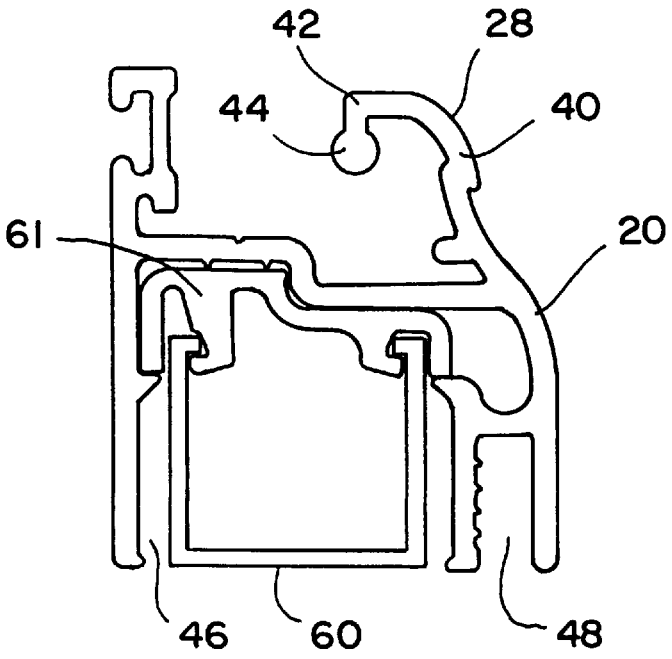
FIG. 5 is a right side cross-sectional view of the frame showing the header retained in the frame taken along line V—V in FIG. 2.

As seen in FIG. 7, the tilt control mechanism, or adjuster, 24 includes a tilt actuator 74, which is slidably mounted on the track 40 along the top side 28 of the frame 20. The tilt actuator 74 includes a rear catch 76 for engaging both the hook 42 and the bulbous end 44 to retain the tilt actuator 74 on the track 40. Additionally, the tilt actuator 74 includes a rearward extending connector 78 for connecting to the remainder of the tilt control mechanism 24. Preferably, the tilt actuator 74 is positioned on the track 40 along the cut-away portion 50; the connector 78 extends through the cut-away portion 50 into the interior 52 of the frame 20.

The remainder of the tilt control mechanism 24 is located within the interior 52 of the frame 20 and is not visible to the user. The tilt control mechanism 24 further includes a helix operator 80 attached to the tilt actuator 74 by the connector 78. The helix operator 80 is additionally affixed to an extension bar 82, preferably with screws or adhesive. The extension bar 82 extends lengthwise within the interior of the header 60 and is supported by left and right brackets 84 and 86 which rest on the floor of the header 60. The front and rear tilt adjustment cords 68 and 69 are secured to the extension bar 82.

As seen in FIGS. 8–11, the height control mechanism, or adjuster, 26 includes a height actuator 88 which is slidably mounted on the track 40 of the left side 32 of the frame 20. The height actuator 88 includes a rear catch 90 which interfits with both the hook 42 and the bulbous end 44 of the track 40 to retain the height actuator 88 on the track 40. The height actuator 88 further includes a spring lock 92 to hold the actuator 88 in a specific position on the track 40. The spring lock 92 includes a handle 86 which has an upper moveable portion 96 and a lower stationary portion 98. The upper portion 96 is held in a locked position by an actuated spring, which presses a lock 100 against the edge of the track 40, thus holding the height actuator 88 in a position on the track 40. When the upper portion 96 is moved into a release position, the lock 100 is removed from contact with the edge of the track 40, thus allowing the height actuator 88 to slide along the track 40.

The height actuator 88 is attached to the second end 66 of the lift adjustment cord 62. The lift adjustment cord 62 extends vertically from the height actuator 88 to the top side 28 of the frame 20 through the interior 102 of the track 40, so that it is not accessible or visible to the user. The lift adjustment cord 62 then passes through a hole 104 in the corner key 36 and into the header 60, from which it descends through the slats 54 of the set of blinds 22. The lift cord 62 is under tension and stretched between the height actuator 88 and the blinds 22 from the pull exerted by the blinds 22 so that it does not fall out of the interior 102 of the track 40.

II. Operation of the Assembly

The assembly 10 is preferably installed over the interior of a door light. However, the assembly 10 may be used in conjunction with any window style or with windows in any type of structure, such as a home or office building.

The assembly 10 is installed by nailing or screwing the frame 20 to an interior window frame. The frame 20 may be supplied with pre-drilled holes (not shown) to aid the user in mounting the assembly 10. The assembly 10 is mounted so that the blinds 20 are sandwiched between the existing window and the pane of glass or plastic.

To raise or lower the blinds 22, the user grasps the handle 94 of the height control mechanism 26 and applies pressure to the upper portion 96 of the handle 94. The pressure forces the upper portion 94 downward, thus releasing the lock 100 from the track 40. The user may then easily slide the height actuator 88 vertically along the track 40. As the user slides the height actuator 88 down, the lift adjustment cord 62 is pulled with it, thus puffing the slats 54 vertically until they are gathered under the header 60. The slats 54 may be raised to any height desired by the user. When the slats 54 are raised to the desired position, the user ceases sliding the height actuator 88 down the track 40 and releases the upper portion 96 of the handle 94; the lock 100 again engages the track 40 to hold the height actuator 88 in place. This, in turn, maintains the slats 54 in the desired position.

To lower the blinds 22, the user again grasps the handle 94 and depresses the upper portion 96 to release the lock 100. The user may then easily slide the height actuator 88 vertically upward along the track 40. As the lift adjustment cord 62 travels upward with the height actuator 88, slack develops in the lift adjustment cord 62, and the slats 54 are released from their gathered position and descend vertically. Again, the user may lock the slats 54 in a specific position by releasing the upper portion 96 of the handle 94 and engaging the lock 100 with the track 40.

To open the blinds 22, the user grasps the tilt actuator 74 and slides it to the middle of the assembly 10 on the track 40. The linear movement of the tilt actuator 74 is translated into rotational movement by the helix operator 80. The extension bar 82 rotates, thus twisting the tilt adjustment cords 64; when the tilt actuator 74 is positioned in the middle of the assembly 10, the front and rear tilt adjustment cords 68 and 69 are level, and the connector cords are horizontal. Thus, the slats 54 lie in a horizontal position, and the blinds 22 are opened.

To close the blinds 22, the user slides the tilt actuator 74 to the left or right from the middle position. Sliding the tilt actuator 74 to the left rotates the helix operator 80 and the extension bar 82 in a clockwise direction, and sliding the actuator 74 to the right rotates the helix operator 80 and the extension bar 82 in a counter-clockwise direction. Rotating the extension bar 82 from its equilibrium position (at which the blinds 22 are open) pulls either the front tilt adjustment cords 68 or the rear tilt adjustment cords 69, respectively, up and into the header 60; the opposite cord 68 or 69 is lowered down into the interior of the assembly 10. Thus, the connector cords move from horizontal to angled positions, and the slats 54, which rest on the connector cords, move into angled, or nearly vertical positions and are closed. The user may slide the tilt actuator 74 to the left or right until the slats 54 are opened or closed the desired amount.

The helix operator 80 limits the distance which the tilt actuator 74 may slide along the track 40. The helix operator 80 and the extension bar 82 are secured by the brackets 84 and 86, and the actuator 74 may slide only along the length of the operator 80 to which it is connected. Therefore, the tilt actuator 74 cannot slide along the entire length of the track 40 of the top side 28.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A window blind assembly including a set of adjustable blinds and a tilt mechanism connected to said blinds, the improvement comprising:

a frame defining a blinds channel receiving said blinds, said frame further defining an actuator channel;

said tilt mechanism including an actuator slidably mounted on said frame and extending into said actuator channel; and said tilt mechanism further including movement means at least partially within said actuator channel for opening and closing said set of blinds in response to movement of said actuator.

2. A window blind assembly including a set of adjustable blinds and a tilt mechanism connected to said blinds, the improvement comprising:

a frame having an integrally formed track;

said tilt mechanism including an actuator slidably mounted on said track;

movement means for opening and closing said set of blinds in response to movement of said actuator; and a rearward extending hook on said track, said actuator positioned on said track and including a rear catch for engaging said hook and retaining said actuator on said track.

3. A window blind assembly including a set of adjustable blinds and a tilt mechanism connected to said blinds, the improvement comprising:

a frame having an integrally formed track;

said tilt mechanism including an actuator slidably mounted on said track;

movement means for opening and closing said set of blinds in response to movement of said actuator, said movement means including a helix operator affixed to an extension bar, said extension bar attached to said set of blinds by at least one adjustment cord, said actuator connected to said helix operator, said tilt actuator moving linearly along said track and rotating said helix operator and said extension bar to move said blinds between an open and a closed position.

4. A window blind assembly including a set of adjustable blinds and a tilt mechanism connected to said blinds, the improvement comprising:

a frame having an integrally formed track;

said tilt mechanism including an actuator slidably mounted on said track;

movement means for opening and closing said set of blinds in response to movement of said actuator; and a height mechanism including a height actuator slidably mounted on said track and movement means for raising and lowering said set of blinds in response to movement of said height actuator.

5. The assembly of claim 4 wherein said height actuator has a spring lock to retain said actuator in a position on said track, said spring lock including a handle having a moveable upper portion and a stationary lower portion, said upper portion retained in a locked position by an actuated spring, said upper portion including a protuberance, said protuberance resting against said track when said upper portion is in said locked position, said upper portion moveable to a release position wherein said protuberance is released from contact with said track.

6. The assembly of claim 4 wherein said lift device includes a lift cord attached at a first end to said height actuator and attached at a second end to said set of blinds and retained within said track.

7. A window blind assembly including a set of adjustable blinds and a height mechanism attached to said blinds, said improvement comprising:

a frame defining a blinds channel receiving said blinds, said frame farther defining an actuator channel;

said height mechanism including an actuator extending into said actuator channel and slidably mounted on said frame; and said height mechanism further including movement means at least partially within said actuator channel for raising and lowering said set of blinds in response to movement of said height actuator.

8. A window blind assembly including a set of adjustable blinds and a height mechanism attached to said blinds, said improvement comprising:

a frame having an integrally formed track defining a track interior;

said height mechanism including a height actuator slidably mounted on said track;

movement means for raising and lowering said set of blinds in response to movement of said height actuator; and a spring lock to retain said height actuator in a position on said track, said spring lock including a handle having a moveable upper portion and a stationary lower portion, said upper portion held in a locked position by an actuated spring, said upper portion including a protuberance, said protuberance resting against said track when said upper portion is in said locked position, said upper portion moveable to a release position wherein said protuberance is released from contact with said track.

9. The assembly of claim 8 wherein said movement means includes a lift cord connected at a first end to said actuator, said lift cord connected at a second end to said set of blinds, said lift cord retained in said interior of said track.

10. A window blind assembly including a set of adjustable blinds and a height mechanism attached to said blinds, said improvement comprising:

a frame having an integrally formed track defining a track interior;

said height mechanism including a height actuator slidably mounted on said track;

movement means for raising and lowering said set of blinds in response to movement of said height actuator; and a rearward extending hook, said height actuator positioned on said track and including a rear catch for engaging said hook and retaining said height actuator on said track.

11. A window blind assembly including a set of adjustable blinds and a height mechanism attached to said blinds, said improvement comprising:

a frame having an integrally formed track defining a track interior;

said height mechanism including a height actuator slidably mounted on said track;

movement means for raising and lowering said set of blinds in response to movement of said height actuator; and a tilt mechanism including a tilt actuator slidably mounted on said track and movement means for opening and closing said set of blinds in response to movement of said tilt actuator.

12. The assembly of claim 11 wherein said rotator includes a helix operator affixed to an extension bar, said extension bar attached to said set of blinds by at least one adjustment cord, said tilt actuator attached to said helix operator, said tilt actuator moving linearly along said track and rotating said helix operator and said extension bar to move said blinds between an open and a closed position.

13. A window blind assembly comprising:

a frame having at least three sides, each of said sides including an integral track having an interior, each of said sides further defining a pane channel and a blind channel;

a set of adjustable blinds, said set having at least three edges, said set positioned within said frame, said edges of said set fitted within said blind channels, said set including a plurality of slats interconnected by at least one adjustment cord;

a pane fitted within said pane channels;

a tilt adjuster including a tilt actuator slidably mounted on said integral track of one of said sides, said tilt adjuster further including tilting means for tilting said blinds between open and closed positions; and a height adjuster including a height actuator slidably mounted on said integral track of one of said sides, said height actuator further including movement means for moving said blinds between raised and lowered positions.

14. The assembly of claim 13 wherein said tilting means comprises:

a helix operator connected to said tilt actuator; and an extension bar connected to said helix operator, said extension bar attached to said set of blinds by said adjustment cord, said tilt actuator moving linearly along said track and rotating said helix operator and said extension bar to move said blinds between an open and a closed position.

15. The assembly of claim 13 wherein said movement means comprises:

a spring lock that, when released, allows said height actuator to slide on said track and, when locked, secures said height actuator in a position on said track;

a lift cord connected at a first end to said height actuator and connected at a second end to said set of blinds, said lift cord retained in said interior of said track.

16. The assembly of claim 15 wherein said spring lock includes a handle having a moveable upper portion and a stationary lower portion, said upper portion retained in a locked position by an actuated spring, said upper portion including a protuberance, said protuberance resting against said track when said upper portion is in said locked position, said upper portion moveable to a release position wherein said protuberance is released from contact with said track, thereby allowing said height actuator to slide on said track.

17. The assembly of claim 13 wherein said track has a rearward extending hook, said tilt and height actuators positioned on said track and each including a rear catch for engaging said hook to retain said actuators on said track.

18. A window blind assembly comprising:

a frame defining a blinds channel and an actuator channel;

a set of adjustable blinds fitted within said blinds channel; and an adjuster slidably mounted on said frame and extending into said actuator channel, said adjuster in mechanical connection with said blinds, said blinds moving in response to movement of said adjuster.

19. A window blind assembly comprising:

a frame having a plurality of edges, one or more of said edges defining a track;

a set of adjustable blinds connected to one or more of said edges;

an adjuster slidably mounted on said track, said adjuster in mechanical connection with said blinds, said blinds moving in response to movement of said adjuster; and a rearwardly extending hook on said track, said adjuster positioned on said track and including a rear catch for engaging said hook and retaining said adjuster on said track.

20. The assembly of claim 18 wherein each of said edges of said frame defines a blind cavity, said set of adjustable blinds retained in said frame by said blind cavities.

21. A window blind assembly comprising:

a frame having a plurality of edges, one or more of said edges defining a track;

a set of adjustable blinds connected to one or more of said edges;

an adjuster slidably mounted on said track, said adjuster in mechanical connection with said blinds, said blinds moving in response to movement of said adjuster; and a spring lock to retain said adjuster in a position on said track, said spring lock including a handle having a moveable upper portion and a stationary lower portion, said upper portion retained in a locked position by an actuated spring, said upper portion including a protuberance, said protuberance resting against said track when said upper portion is in said locked position, said upper portion moveable to a release position wherein said protuberance is released from contact with said track, thereby allowing said adjuster to slide on said track.

22. The assembly of claim 18 wherein said adjuster includes an actuator and a lift cord, said actuator slidably mounted on said track, said lift cord attached at a first end to said actuator and attached at a second end to said set of blinds, said lift cord retained within said frame, said lift cord and said blinds moving in response to movement by said actuator.

23. A window blind assembly comprising:

a frame having a plurality of edges, one or more of said edges defining a track;

a set of adjustable blinds connected to one or more of said edges;

an adjuster slidably mounted on said track, said adjuster in mechanical connection with said blinds, said blinds moving in response to movement of said adjuster; and an actuator slidably mounted on said track, a helix operator connected to said actuator, an extension bar connected to said helix operator and connected to said blinds by at least one adjustment cord, said actuator moving linearly along said track and rotating said helix operator and said extension bar to move said blinds between an open and a closed position.

* * * * *